United States Patent [19]

Ferguson

[11] Patent Number: 4,623,313

[45] Date of Patent: Nov. 18, 1986

[54] PIVOTAL AIR INDUCTION FOR MARINE PROPULSION DEVICE

[75] Inventor: Arthur R. Ferguson, Northbrook, Ill.

[73] Assignee: Outboard Marine Corporation, Waukegan, Ill.

[21] Appl. No.: 631,407

[22] Filed: Jul. 16, 1984

Related U.S. Application Data

[63] Continuation-in-part of Ser. No. 605,141, Apr. 30, 1984, Pat. No. 4,545,770, which is a continuation-in-part of Ser. No. 293,324, Aug. 17, 1981, Pat. No. 4,449,945.

[51] Int. Cl.[4] ..... B63H 21/36

[52] U.S. Cl. ..... 440/77; 440/88; 440/112

[58] Field of Search ..... 440/53, 88, 113, 900, 440/112, 77; 285/151, 156, 189, 223, 272

[56] References Cited

U.S. PATENT DOCUMENTS

| | | | |
|---|---|---|---|
| 2,752,198 | 6/1956 | Crow | 285/272 |
| 4,076,282 | 2/1978 | Scott | 285/156 |
| 4,371,348 | 2/1983 | Blanchard | 440/52 |
| 4,375,356 | 3/1983 | Stevens | 440/112 |
| 4,395,238 | 7/1983 | Payne | 440/53 |
| 4,403,971 | 9/1983 | Kobayashi et al. | 440/88 |
| 4,416,475 | 11/1983 | Stacey | 285/272 |
| 4,449,945 | 5/1984 | Ferguson | 440/53 |

*Primary Examiner*—Trygve M. Blix
*Assistant Examiner*—Stephen P. Avila
*Attorney, Agent, or Firm*—Michael, Best & Friedrich

[57] ABSTRACT

A marine propulsion device comprising a mounting bracket assembly adapted to be mounted on a boat transom for pivotal movement relative to the boat transom about a generally horizontal tilt axis, a propulsion unit including an internal combustion engine and rotatably connected to the mounting bracket assembly for rotation relative to the mounting bracket assembly about a generally vertical steering axis, and for common pivotal movement with the mounting bracket assembly about the tilt axis, a shroud substantially enclosing the engine, and a duct including a first rigid portion adapted for connection to and through the transom of the boat, and a second rigid portion communicating with and being rotatably connected to the first rigid portion for rotation about the tilt axis, and communicating with and being rotatably connected to the shroud for rotation about the steering axis.

21 Claims, 4 Drawing Figures

PIVOTAL AIR INDUCTION FOR MARINE PROPULSION DEVICE

RELATED APPLICATION

This application is a continuation-in-part of U.S. application Ser. No. 605,141, filed Apr. 30, 1984 now U.S. Pat. No. 4,545,770 issued Oct. 8, 1985 and entitled "Outboard Motor Mounting Arrangement", and which is a continuation-in-part of Ser. No. 293,324, filed Aug. 17, 1981, now U.S. Pat. No. 4,449,945, issued May 22, 1984 and entitled "Outboard Motor Mounting Arrangement."

BACKGROUND OF THE INVENTION

Outboard motors are designed to minimize the likelihood of taking water into the engine during rain or high sea conditions. Typically the engine shrouds are designed to provide such protection. Large outboard motors are likely to be used on large boats designed for offshore operation where sea conditions can be severe. It is not desirable to operate such boats with standard or conventional high (20 inch) transoms which can allow a following sea to enter the boat. Therefore, such boats typically mount an outboard on a bracket behind an extra high transom. In order to provide combustion air for the engine, such outboards have sometimes been provided with a flexible air supply hose or duct connected between the engine shroud and the the transom and extending through the transom to supply air from the cockpit of the boat. As a result, tilting and turning of the motor involves flexure of the duct which adds to the tilting and steering effort.

Attention is directed to the following U.S. patents:

Stevens U.S. Pat. No. 4,375,356, issued Mar. 1, 1983;

Blanchard U.S. Pat. No. 4,371,348, issued Feb. 1, 1983; and

Payne U.S. Pat. No. 4,395,238, issued July 26, 1983.

SUMMARY OF THE INVENTION

The invention provides a marine propulsion device comprising a mounting bracket assembly adapted to be mounted on a boat transom for pivotal movement relative to the boat transom about a generally horizontal tilt axis, a propulsion unit including an internal combustion engine and being rotatably connected to the mounting bracket assembly for rotation relative to the mounting bracket assembly about a generally vertical steering axis, and for common pivotal movement with the mounting bracket assembly about the tilt axis, a shroud substantially enclosing the engine, a duct means including a first rigid portion adapted for connection to and through the transom of the boat, and a second rigid portion communicating with and being rotatably connected to the first rigid portion for rotation about the tilt axis, and communicating with and being rotatably connected to the shroud for rotation about the steering axis.

The invention also provides a marine propulsion device comprising a mounting bracket assembly adapted to be mounted on a boat transom for pivotal movement relative to the boat transom about a generally horizontal tilt axis, a propulsion unit including an internal combustion engine and rotatably connected to the mounting bracket assembly for rotation relative to the mounting bracket assembly about a generally vertical steering axis, and for common pivotal movement with the mounting bracket assembly about the tilt axis, a shroud substantially enclosing the engine and having therein a combustion air opening centered on the steering axis, and duct means including a first rigid portion adapted for connection to and through the transom of the boat to enable the engine to draw combustion air from the interior of the boat, a second rigid portion opening downwardly through the shroud at the opening and being rotatably connected to the shroud for rotation about the steering axis, and means interconnecting the first and second rigid portions such that the second rigid portion is rotatable relative to the first rigid portion about the tilt axis.

The invention also provides a marine propulsion device comprising a mounting bracket assembly adapted to be mounted on a boat transom for pivotal movement relative to the boat transom about a generally horizontal tilt axis, a propulsion unit including an internal combustion engine and being rotatably connected to the mounting bracket assembly for rotation relative to the mounting bracket assembly about a generally vertical steering axis, and for common pivotal movement with the mounting bracket assembly about the tilt axis, a shroud substantially enclosing the engine and having an inner surface, and outer surface, and an upper portion having a combustion air opening centered on the steering axis. The device also comprises duct means including a first rigid portion adapted for connection to and through the transom of the boat to enable the engine to draw combustion air from the interior of the boat, and a second rigid portion having a downwardly extending first tubular portion projecting through the opening in the shroud and being rotatably connected to the shroud for rotation about the steering axis. The first tubular portion has a groove disposed inside the shroud and a retaining ring engaged in the groove and overlying the inner surface of the shroud to retain the first rigid portion in the opening. The first tubular portion also includes a shoulder engaging the outer surface of the shroud opposite the retaining ring, and a seal engaging the shoulder and the outer surface of the shroud adjacent the shoulder. The duct means further includes means interconnecting the first and second rigid portions such that the second rigid portion is rotatable relative to the first rigid portion about the tilt axis, the means interconnecting the first and second rigid portions including a second tubular portion integrally extending from the second rigid portion, a circular opening in the first rigid portion receiving the second tubular portion, and an annular seal surrounding the second tubular portion and engaging the first rigid portion around the circular opening.

The invention also provides a marine propulsion device comprising a mounting bracket assembly, a propulsion unit including an internal combustion engine and being rotatably connected to the mounting bracket assembly for rotation relative to the mounting bracket assembly about a generally vertical steering axis, a shroud substantially enclosing the engine and having therein a combustion air opening centered on the steering axis, and rigid duct means having opposite first and second ends, the first end communicating with the opening and being rotatably connected to the shroud for rotation about the steering axis, and the second end being adapted for connection to and through the transom of a boat to enable the engine to draw combustion air from the interior of the boat.

The invention also provides a marine vehicle comprising a boat including a transom having an opening therein, a mounting bracket assembly mounted on the transom for pivotal movement relative to the transom about a generally horizontal tilt axis, a propulsion unit including an internal combustion engine and being rotatably connected to the mounting bracket assembly for rotation relative to the mounting bracket assembly about a generally vertical steering axis, and for common pivotal movement with the mounting bracket assembly about the tilt axis, a shroud substantially enclosing the engine, and duct means including a first rigid portion communicating with the opening in the transom and a second rigid portion communicating with and being rotatably connected to the first rigid portion for rotation about the tilt axis, and communicating with and being rotatably connected to the shroud for rotation about the steering axis.

A principal feature of the invention is the provision of an air induction system that offers minimal resistance to steering and tilting of the outboard motor.

Other features and advantages of the invention will become apparent to those skilled in the art upon review of the following detailed description, claims, and drawings.

Figure 2:
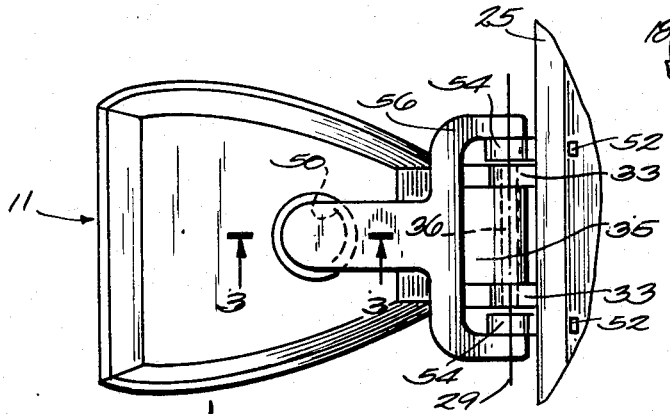
FIG. 2 is a top view of the marine propulsion device shown in FIG. 1.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should be not be regarded as limiting.

DESCRIPTION OF THE PREFERRED EMBODIMENT

Shown in the drawings is a marine propulsion device which is in the form of an outboard motor 11 and which includes a generally conventional propulsion unit 13 incorporating a power head 15 with an internal combustion engine 17. The engine 17 is protected against ingesting water by a shroud 18 including a lower pan 20 and an upper dome-like portion 22. The propulsion unit 13 also includes a lower unit 19 incorporating a rotatably mounted propeller 21 drivingly connected to the engine 17 through a selectively operable reversing transmission 23.

The marine propulsion device also includes means connecting the propulsion unit 13 to the rear of a boat transom 25 for pivotal movement of the propulsion unit 13 relative to the boat transom 25 about a steering axis 27, and, in the preferred embodiment, for pivotal movement of the propulsion unit 13 relative to the transom 25 about a horizontal tilt axis 29.

Thus, while other connecting means could be employed, in the preferred embodiment, the outboard motor 11 also includes a mounting assembly 31 for mounting the propulsion unit 13 to the boat transom 25 such that the propulsion unit 13 is vertically swingable between a lowermost running position with the propeller 21 submerged in water and a fully raised position with the propeller 21 out of the water. In the illustrated construction, the mounting assembly 31 comprises a transom bracket assembly 33 including a mounting portion adapted to be secured, by bolts or other suitable means, to the boat transom 25, and a pair of laterally spaced arms extending upwardly from the mounting portion and including an upper end having means for pivotally mounting a swivel bracket assembly 35 for swinging movement of the swivel bracket assembly 35 about the horizontal tilt axis 29.

While other arrangements could be employed, the means pivotally mounting the swivel bracket assembly 35 from the transom bracket assembly 33 comprises a suitable tilt pin extending horizontally through the upper end of the swivel bracket assembly 35 and into the upper ends of the arms of the transom bracket assembly 33. The tilt pin 36 does not substantially extend outwardly of the transom bracket assembly 33.

While other constructions could be employed, in the illustrated construction the swivel bracket assembly 35 includes a vertical bore adapted to receive a king pin 41 fixed to and forming a part of the propulsion unit 13. The longitudinal axis of the king pin 41 is also the steering axis 27 of the propulsion unit 13.

It should be noted that the transom bracket assembly 33, swivel bracket assembly 35, and king pin 41 are merely the preferred means for connecting the propulsion unit 13 to the boat transom 25. However, any suitable means for making this connection is within the scope of the invention.

The marine propulsion device also includes duct means 43 including a first rigid portion adapted for connection to and through the transom 25, and a second rigid portion communicating with and being rotatably connected to the first rigid portion for rotation about the tilt axis 29, and communicating with and being rotatably connected to the engine shroud 18 for rotation about the steering axis 27.

Air for the engine 17 is drawn from inside the cockpit of the boat, that is, from the forward side of the transom 25, through the duct means 43 which communicates between a combustion air opening 50 in the engine shroud 18 and one or a pair of openings 52 through the transom 25. The combustion air opening 50 is in the top of the upper portion 22 of the engine shroud 18 and is centered on the steering axis 27. In the preferred embodiment, a pair of openings 52 through the transom 25 are positioned with one opening 52 on either side of the transom bracket assembly 33 adjacent the tilt axis 29.

Figure 4:
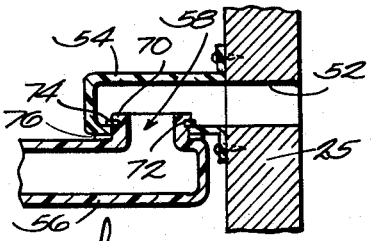
FIG. 4 is a cross-sectional view taken along line 4—4 in FIG. 1.

While various suitable duct means 43 could be employed, in the preferred embodiment, the duct means 43 includes a pair of airboxes 54 communicating with respective openings 52 in the transom 25. The airboxes 54 extend rearwardly of the transom 25 and can be attached to the transom 25 by any suitable means, such as screws as shown in FIG. 4. Each airbox 54 includes an aperture 58 (see FIG. 4) centered on the tilt axis 29. In the illustrated construction, the apertures 58 are outwardly facing, but such openings could also be inwardly facing.

The duct means 43 also includes a generally Y-shaped conduit 56 communicating between the airboxes 54 and the combustion air opening 50. The Y-shaped conduit 56 has a base or rearward portion communicating with the combustion air opening 50 and rotatably connected to the engine shroud 18 for rotation about the steering axis 27. The base portion extends forwardly (toward the transom 25) from the combustion air opening 50, and a pair of arms branch from the base portion and extend forwardly and downwardly to the airboxes 54. Each arm extends on one side of the transom bracket assembly 33 and has a forward end communicating with and rotatably connected to the airbox 54 on the associated side of the transom bracket assembly 33. The arms of the Y-shaped conduit 56 are rotatably connected to the airboxes 54 for rotation about the tilt axis 29.

Figure 3:
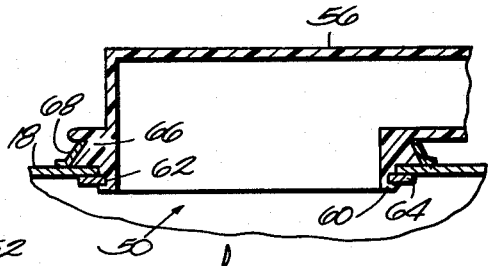
FIG. 3 is a cross-sectional view taken along line 3—3 in FIG. 2.

The connection between the base portion of the Y-shaped conduit 56 and the engine shroud 18 is best shown in FIG. 3. The conduit 56 has a tubular portion 60 projecting downwardly through the combustion air opening 50 to position a groove 62 below the inside surface of the shroud 18. The conduit 56 includes means preventing axial movement of the tubular portion 60 relative to the shroud 18. While various suitable means could be employed for this purpose, in the preferred embodiment, such means includes a snap ring 64 received in the groove 60, and an annular shoulder 66 engaging the outside of the cover 18 adjacent the opening 50. An annular seal 68 surrounds the shoulder 66 and engages the outside of the shroud 18 for sealing the joint between the shoulder 66 and the shroud 18 while permitting the conduit 56 to rotate relative to the shroud 18.

The forward end of each arm of the Y-shaped conduit 56 is similarly connected to its respective airbox 54. As best shown in FIG. 4, in the preferred embodiment, each arm includes a tubular portion 70 extending inwardly through the aperture 58 in the airbox 54 to position a groove 72 inwardly of the inside surface of the airbox 54. The conduit 56 includes means preventing axial movement of the tubular portions 70 relative to the airboxes 54. While various suitable means could be employed for this purpose, in the preferred embodiment, such means includes a snap ring 74 received in the groove 72 of each of the tubular portions 70. An annular seal 76 surrounds each of the tubular portions 70 and engages the outer surface of the airbox 54 adjacent the aperture 58 for sealing the joint between the arm and the airbox 54 while permitting rotation of the arm relative to the airbox 54.

Figure 1:
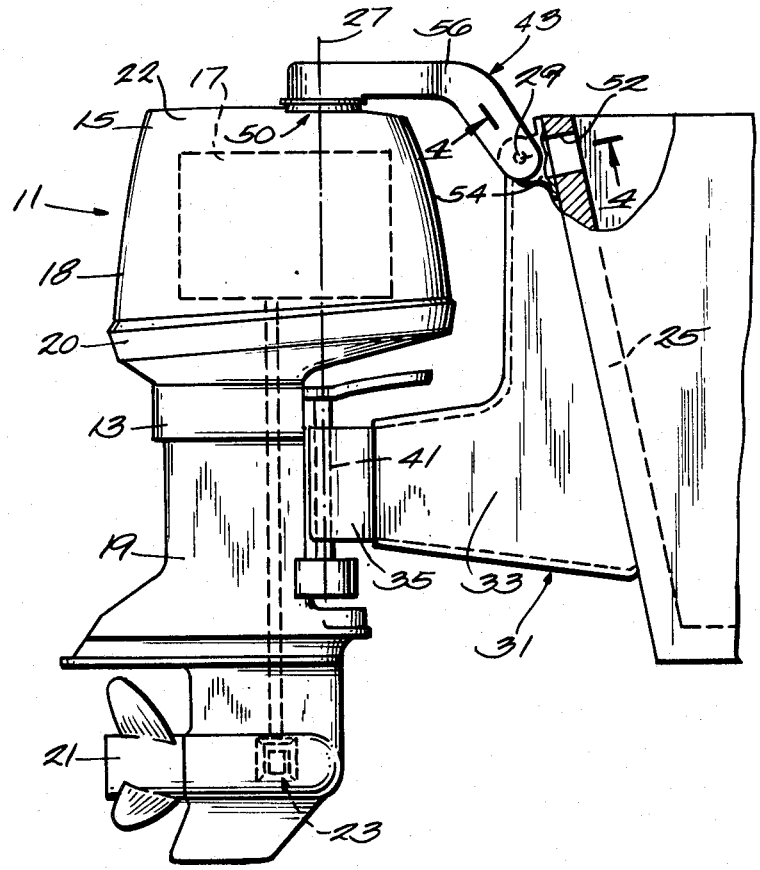
FIG. 1 is a side elevational view of a marine propulsion device embodying the invention and mounted on the transom of a boat.

As is apparent from viewing FIGS. 1 and 2, the engine shroud 18 rotates relative to the Y-shaped conduit 56 as the outboard motor 11 is turned for steering. The Y-shaped conduit 56 and airboxes 54 do not move relative to the boat transom 25 during steering. When the outboard motor 11 is tilted in order to raise the propeller 21, the Y-shaped conduit 56 rotates relative to the airboxes 54 about the tilt axis 29. The Y-shaped conduit 56 does not move relative to the outboard motor 11 during tilting.

Combustion air enters the airboxes 54 from the cockpit of the boat through the openings 52 in the transom 25. The air passes through the airboxes 54 and into the arms of the Y-shaped conduit 56 where it is directed to the combustion air opening 50 in the engine shroud 18. The chance of water entering the shroud 18 either with a wave breaking over the motor 11 or with momentary submerging of the transom 25 is minimized. Even if water were momentarily admitted into the duct means, the water would almost surely not be ingested by the engine 17. Any water entering the engine shroud 18 would collect in the lower pan 20 and could be removed by any suitable pumping or drainage means.

Various features of the invention are set forth in the following claims.

I claim:

1. A marine propulsion device comprising a mounting bracket assembly adapted to be mounted on a boat transom for pivotal movement relative to the boat transom about a generally horizontal tilt axis, a propulsion unit including an internal combustion engine and being rotatably connected to said mounting bracket assembly for rotation relative to said mounting bracket assembly about a generally vertical steering axis, and for common pivotal movement with said mounting bracket assembly about said tilt axis, a shroud substantially enclosing said engine, and duct means including a first rigid portion adapted for connection to and for communication through the transom of the boat, and a second rigid portion communicating with and being rotatably connected to said first rigid portion for rotation about said tilt axis, and communicating with and being rotatably connected to said shroud for rotation about said steering axis.

2. A marine propulsion device as set forth in claim 1 wherein said shroud has an upper portion having therein a combustion air opening centered on said steering axis, and wherein said second rigid portion has a downwardly extending first tubular portion projecting through said combustion air opening and being rotatably connected to said shroud for rotation about said steering axis.

3. A marine propulsion device as set forth in claim 2 wherein said shroud has an inner surface and wherein said first tubular portion has a groove disposed inside said shroud, and a retaining ring engaged in said groove and overlying said inner surface of said shroud to retain said second rigid portion in said combustion air opening.

4. A marine propulsion device as set forth in claim 3 wherein said shroud has an outer surface and wherein said first tubular portion includes a shoulder engaging said outer surface opposite said retaining ring.

5. A marine propulsion device as set forth in claim 4 and further comprising a seal engaging said shoulder and said outer surface of said shroud adjacent said shoulder.

6. A marine propulsion device as set forth in claim 1 wherein said second rigid portion has a second tubular portion integrally extending from said second rigid portion, and wherein said first rigid portion has a circular opening receiving said second tubular portion.

7. A marine propulsion device as set forth in claim 6 and further comprising an annular seal surrounding said second tubular portion and engaging said first rigid portion around said circular opening.

8. A marine propulsion device comprising a mounting bracket assembly adapted to be mounted on a boat transom for pivotal movement relative to the boat transom about a generally horizontal tilt axis, a propulsion unit including an internal combustion engine and being rotatably connected to said mounting bracket assembly for rotation relative to said mounting bracket assembly about a generally vertical steering axis, and for common pivotal movement with said mounting bracket assembly about said tilt axis, a shroud substantially enclosing said engine and having therein a combustion air opening centered on said steering axis, and duct means including a first rigid portion adapted for connection to and for communication through the transom of the boat to enable said engine to draw combustion air from the interior of the boat, a second rigid portion opening downwardly through said shroud at said opening and being rotatably connected to said shroud for rotation about said steering axis, and means interconnecting said first and second rigid portions such that said second rigid portion is rotatable relative to said first rigid portion about said tilt axis.

9. A marine propulsion device according to claim 8 wherein said shroud has an upper portion having therein said combustion air opening, and wherein said second rigid portion has a downwardly extending first tubular portion projecting through said opening in said shroud.

10. A marine propulsion device according to claim 9 wherein said shroud has an inner surface and wherein said first tubular portion has a groove disposed inside said shroud, and a retaining ring engaged in said groove and overlying said inner surface of said shroud to retain said second rigid portion in said opening.

11. A marine propulsion device according to claim 10 wherein said shroud has an outer surface and wherein said first tubular portion includes a shoulder engaging said outer surface of said shroud opposite said retaining ring.

12. A marine propulsion device according to claim 11 and further comprising a seal engaging said shoulder and said outer surface of said shroud adjacent said shoulder.

13. A marine propulsion device according to claim 8 wherein said means interconnecting said first and second rigid portions includes a second tubular portion integrally extending from said second rigid portion, and a circular opening in said first rigid portion receiving said second tubular portion.

14. A marine propulsion device according to claim 13 and further comprising an annular seal surrounding said second tubular portion and engaging said first rigid portion around said circular opening.

15. A marine propulsion device comprising a mounting bracket assembly adapted to be mounted on a boat transom for pivotal movement relative to the boat transom about a generally horizontal tilt axis, a propulsion unit including an internal combustion engine and being rotatably connected to said mounting bracket assembly for rotation relative to said mounting bracket assembly about a generally vertical steering axis, and for common pivotal movement with said mounting bracket assembly about said tilt axis, a shroud substantially enclosing said engine and having an inner surface, an outer surface, and an upper portion having a combustion air opening centered on said steering axis, and duct means including a first rigid portion adapted for connection to and for communication through the transom of the boat to enable said engine to draw combustion air from the interior of the boat, said duct means also including a second rigid portion having a downwardly extending first tubular portion projecting through said opening in said shroud and being rotatably connected to said shroud for rotation about said steering axis, said first tubular portion having a groove disposed inside said shroud, a retaining ring engaged in said groove and overlying said inner surface of said shroud to retain said second rigid portion in said opening, a shoulder engaging said outer surface of said shroud opposite said retaining ring, and a seal engaging said shoulder and said outer surface of said shroud adjacent said shoulder, and said duct means further including means interconnecting said first and second rigid portions such that said second rigid portion is rotatable relative to said first rigid portion about said tilt axis, said means interconnecting said first and second rigid portions including a second tubular portion integrally extending from said second rigid portion, a circular opening in said first rigid portion receiving said second tubular portion, and an annular seal surrounding said second tubular portion and engaging said first rigid portion around said circular opening.

16. A marine propulsion device comprising a mounting bracket assembly, a propulsion unit including an internal combustion engine and being rotatably connected to said mounting bracket assembly for rotation relative to said mounting bracket assembly about a generally vertical steering axis, a shroud substantially enclosing said engine and having therein a combustion air opening centered on said steering axis, and rigid duct means having opposite first and second ends, said first end communicating with said opening and being rotatably connected to said shroud for rotation about said steering axis, and said second end being adapted for connection to and for communication through the transom of a boat to enable said engine to draw combustion air from the interior of the boat.

17. A marine propulsion device according to claim 16 wherein said shroud has an upper portion, wherein said combustion air opening is in said upper portion of said shroud, and wherein said rigid duct means has a downwardly extending first tubular portion projecting through said opening in said shroud.

18. A marine propulsion device according to claim 17 wherein said shroud has an inner surface and wherein said first tubular portion has a groove disposed inside said shroud, and a retaining ring engaged in said groove and overlying said inner surface of said shroud to retain said rigid duct means in said opening.

19. A marine propulsion device according to claim 18 wherein said shroud has an outer surface and wherein said first tubular portion includes a shoulder engaging said outer surface of said shroud opposite said retaining ring.

20. A marine propulsion device according to claim 19 and further comprising a seal engaging said shoulder and said outer surface of said shroud adjacent said shoulder.

21. A marine vehicle comprising a boat including a transom having an opening therein, a mounting bracket assembly mounted on said transom for pivotal movement relative to said transom about a generally horizontal tilt axis, a propulsion unit including an internal combustion engine and being rotatably connected to said mounting bracket assembly for rotation relative to said mounting bracket assembly about a generally vertical steering axis, and for common pivotal movement with said mounting bracket assembly about said tilt axis, a shroud substantially enclosing said engine, and duct means including a first rigid portion communicating with said opening in said transom, and a second rigid portion communicating with and being rotatably connected to said first rigid portion for rotation about said tilt axis, and communicating with and being rotatably connected to said shroud for rotation about said steering axis.

* * * * *